United States Patent [19]

Neradka et al.

[11] 4,265,162

[45] May 5, 1981

[54] SERVOVALVE HAVING FLUIDIC ACTUATOR

[76] Inventors: Vincent F. Neradka, 13806 Drake Dr., Rockville, Md. 20853; Francis M. Manion, 1705 Evelyn Dr., Rockville, Md. 20852

[21] Appl. No.: 42,292

[22] Filed: May 25, 1979

[51] Int. Cl.[3] ..... F01B 25/02; F15B 15/22

[52] U.S. Cl. ..... 91/3; 91/6; 91/24; 91/359; 91/459

[58] Field of Search ..... 91/3, 24, 25, 359, 410, 91/6

[56] References Cited

U.S. PATENT DOCUMENTS

| | | | |
|---|---|---|---|
| 2,917,026 | 12/1959 | Hall et al. | 91/359 |
| 3,386,343 | 6/1968 | Gray | 91/3 |
| 3,464,318 | 9/1969 | Thayer et al. | 91/359 |
| 3,739,689 | 6/1973 | Craven | 91/3 |
| 3,772,962 | 11/1973 | Suzuki | 91/359 |

*Primary Examiner*—Paul E. Maslousky
*Attorney, Agent, or Firm*—Ira C. Edell

[57] ABSTRACT

A fluidic driver amplifier for a servovalve has its controllably directed fluid jet differentially divided by a divider element which moves with a main valve piston in a manner to equalize the differential pressure received from the jet when the piston reaches the commanded position. In order to permit use of a small, low-leakage, fluidic driven amplifier, without the disadvantage of reduced speed of response, a derivative piston is linked to move with the main piston and displace fluid in a chamber containing a spring-centered secondary valve piston. When displaced, the secondary piston admits pressurized fluid into the main valve chamber in a positive feedback sense to aid the fluidic driver in positioning the main piston. The secondary piston is displaced only when the main piston is in motion and therefore has no effect once the main piston reaches the commanded position.

13 Claims, 11 Drawing Figures

SPOOL
SPOOL
FLAPPER
BELLOWS
FEEDBACK FLAPPER
ACTUATOR

SERVOVALVE HAVING FLUIDIC ACTUATOR

TECHNICAL FIELD

The present invention relates to improvements in servovalves and, more particularly, to improved fluidic drive and response speed arrangements for servovalves.

Prior art attempts to drive a servovalve directly from a fluidic amplifier resulted in poor time response when a fluidic element having desirably high output impedance was used. For fluidic elements of lower output impedance (i.e. large elements) the leakage flow is excessive. By leakage flow is meant that which passes through the fluidic element when the servo-actuator is stationary. Servovalves have the ability to completely shut off flow during the stationary condition whereas fluidic elements must have continuous through flow in order to function; hence inclusion of a fluidic driver element must be at the expense of flow. As an alternative to direct fluidic drive, a fluidic element has been used to drive a bellows which, in turn, drives a flapper nozzle. This permits use of lower applied pressures to the fluidic element, thereby providing less leakage flow, but it does little if anything for the speed of response of the overall servovalve. This approach also requires a larger package and introduces reliability problems. Regardless of which of the aforementioned servovalve drive techniques are used, it is necessary that the servovalve position be fed back to signify that it has arrived at its commanded position. Feedback paths to date have been mechanical linkage, which is subject to wear, stiction and compliance, or hydraulic, which is subject to both pressure fluctuations and viscosity-dependence on temperature. The criticality of this feedback can be seen from the signal flow diagram of a typical prior art electrio-fluidic servovalve in FIG. 1, to which reference is now made. The driving function is applied to the servovalve through either an electrical current source i (driving a torque motor, for example, having the displacement coefficient y/i) of a fluidic source $P_i$. In either case a pressure is applied to the bellows input, as signified by the summing junction. The pressure across the bellows input resistance R fills the bellows through the bellows capacitance $C_B$. As the pressure builds up in the bellows it is fed back to input 1 to reduce the pressure differential across the input resistance R. The pressure within the bellows acts on the effective bellows area $A_B$ to effect a displacement $x_B$ through the bellows spring $k_1$. This displacement, as a function of the bellows area, feeds back a swept volume signal to reduce the net flow into the bellows. The displacement also acts on the servovalve flapper nozzle through its characteristic dP/dx to generate a pressure on the spool valve. This pressure, acting through an input resistor $R_1$, ultimately provides a displacement of the spool $x_s$ as a function of $x_B$. Change in the spool position $x_s$ changes the area through which the flow enters the servo actuator. The spool characteristic dQ/dx is a function of porting design. The resultant flow into the actuator cylinder volume is integrated to yield pressure which becomes actuator ram displacement by virtue of the pressure acting on the actuator area $A_A$ through the spring rate $Z_L$. The actuator ram displacement, i.e. the commanded position, is fed back hydraulically to the first summing junction 1 through the flapper nozzle with its characteristic $dP/dx_f$. Alternatively, feedback would be through the mechanical linkage $l_F$ directly to the flapper nozzle.

In order for the servo actuator to be useful, it must have a high forward gain; that is, a large actuator displacement must be obtained from a small input pressure. It is difficult to make the flapper $dP/dx_f$ large enough to obtain optimal performance.

The transfer function for any closed loop feedback control system is $$\frac{\text{Output}}{\text{Input}} = \frac{G}{1 + GH} \tag{1}$$

which for large G (high forward gain) becomes 1/H. Applying this to the block diagram of FIG. 1, $$\left.\begin{aligned} G &= \frac{A_B \frac{dP}{dx} A_s \frac{dQ}{dx} A_A}{[k_1(RC_Bs + 1) + RA_B^2s][(R_1C_ss + 1)(r_ss + k_s) + RA_s^2s][(Z_iC_A + A_A^2)s]} \\ &\text{and } H \text{ is defined as} \\ H &= \frac{dP}{dx_f} \end{aligned}\right\} \tag{2}$$

If the gain G is high in Equation 2, Equation 1 becomes $$\frac{\text{Output}}{\text{Input}} = \frac{1}{\left(\frac{dP}{dx}\right)_f} \tag{3}$$

From the above it is obvious that any temperature or pressure variation which alters the flapper characteristic also alters the input/output characteristic of the valve. The same holds true for mechanical feedback variations due to wear, binding, etc. The importance of this feedback cannot be overstressed; any errors in the feedback cause the actuator to go to some position other than the commanded position.

It is therefore an object of the present invention to provide a servovalve in which the operating characteristics have minimal or no dependence upon temperature and pressure fluctuations. It is a further object of the present invention to provide a servovalve which may be driven fluidically with minimal leakage flow and without sacrificing speed of response.

It is a further object of the present invention to provide a feedback arrangement for a servovalve which permits accurate positioning of the valve in response to a positive command signal.

It is still a further object of the present invention to maximize speed of response in a servovalve.

DISCLOSURE OF THE INVENTION

In accordance with the present invention a fluidic drive element for a servovalve includes a jet flow splitter which is movable with the main spool valve piston to directly reduce the pressure differential applied by the fluidic element to the piston. In one embodiment the splitter is in the form of a flexible beam which extends radially from the piston and is restrained at some point along its length from moving transversely with the piston. The result is a cantilever effect whereby the end of the beam remote from the piston flexes in the opposite direction to the piston movement to vary the areas of the flow passages defined by the splitter inversely to the applied differential pressure. The applied differential pressure decreases due to splitter movement until the command position is reached, whereupon the piston remains in the commanded position. The piston position is thus fed directly back to the fluidic drive element by means of the flow splitter, thereby avoiding the need for hydraulic or mechanical linkage feedback and their attendant disadvantages as described above. Moreover, temperature effects on the feedback signal are minimized because both of the components of the pressure differential are affected in the same way by temperature changes.

In order to minimize any overdamping that would be caused by using a high impedance fluidic driver amplifier, a positive feedback arrangement is employed. Specifically, a derivative piston, linked rigidly (or by a static hydraulic linkage) to the main servovalve piston, displaces fluid in a cylinder. The displaced fluid is both exhausted, through a controllably restricted exhaust passage, and utilized to displace a secondary piston of a spring-centered second spool valve. When displaced, the secondary piston admits pressurized fluid to the main piston chamber through low impedance orifices to aid in the commanded displacement of the main piston. The secondary piston is displaced only when the main piston is in motion so that the secondary piston has no effect on the main piston after the main piston reaches the commanded position.

BRIEF DESCRIPTION OF THE DRAWINGS

The above and still further objects, features and advantages of the present invention will become apparent upon consideration of the following detailed description of one specific embodiment thereof, especially when taken in conjunction with the accompanying drawings, wherein.

BEST MODE OF CARRYING OUT THE INVENTION

Figure 1:
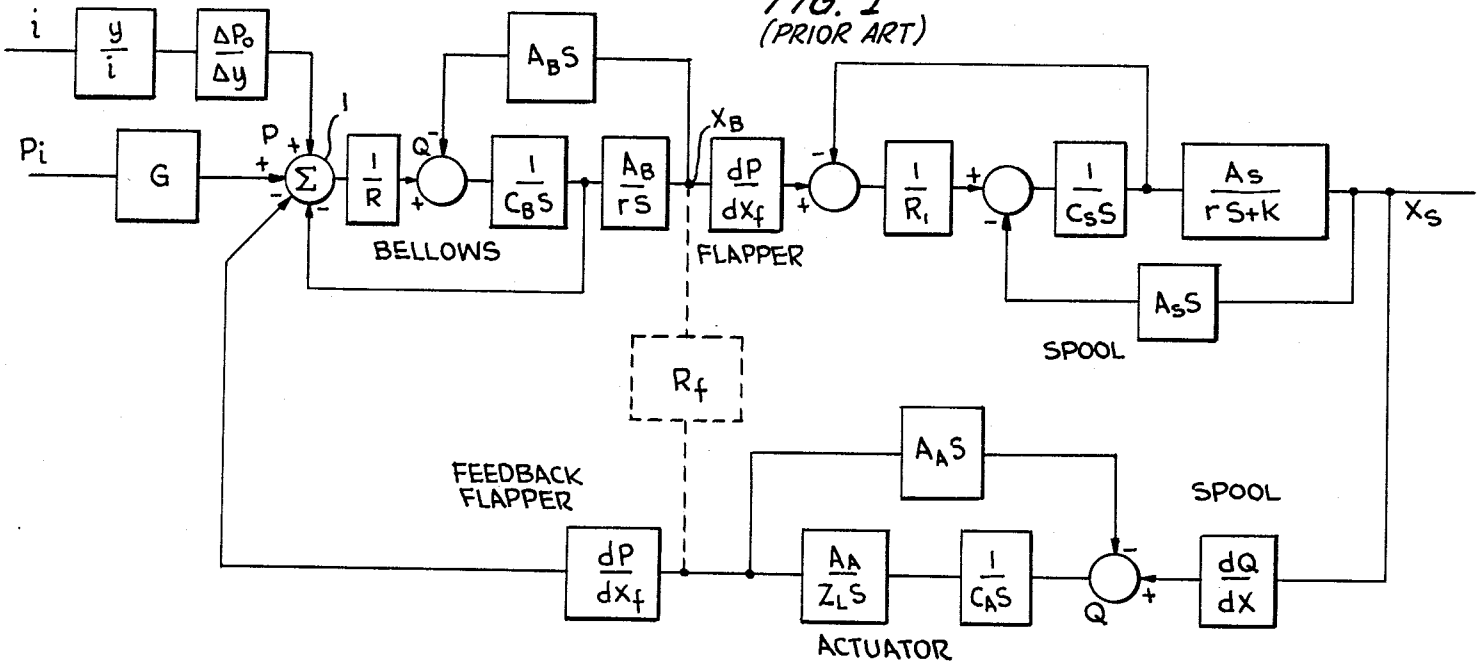
FIG. 1 (PRIOR ART)
FIG. 1 is a mathematical model block diagram of a typical prior art servo-actuator system.
Figure 4:
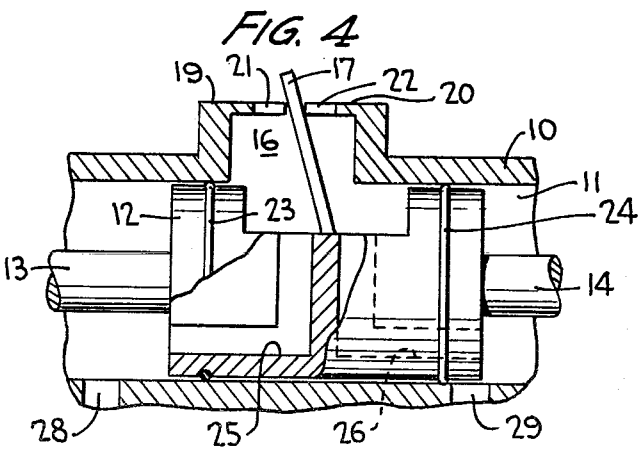
FIG. 4 is side view in partial section of the piston and flow divider portions of the servo actuator of FIG. 2.
Figure 3:
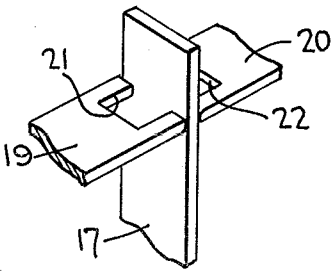
FIG. 3 is a view in perspective of the flow divider element of the servo actuator of FIG. 2.
Figure 2:
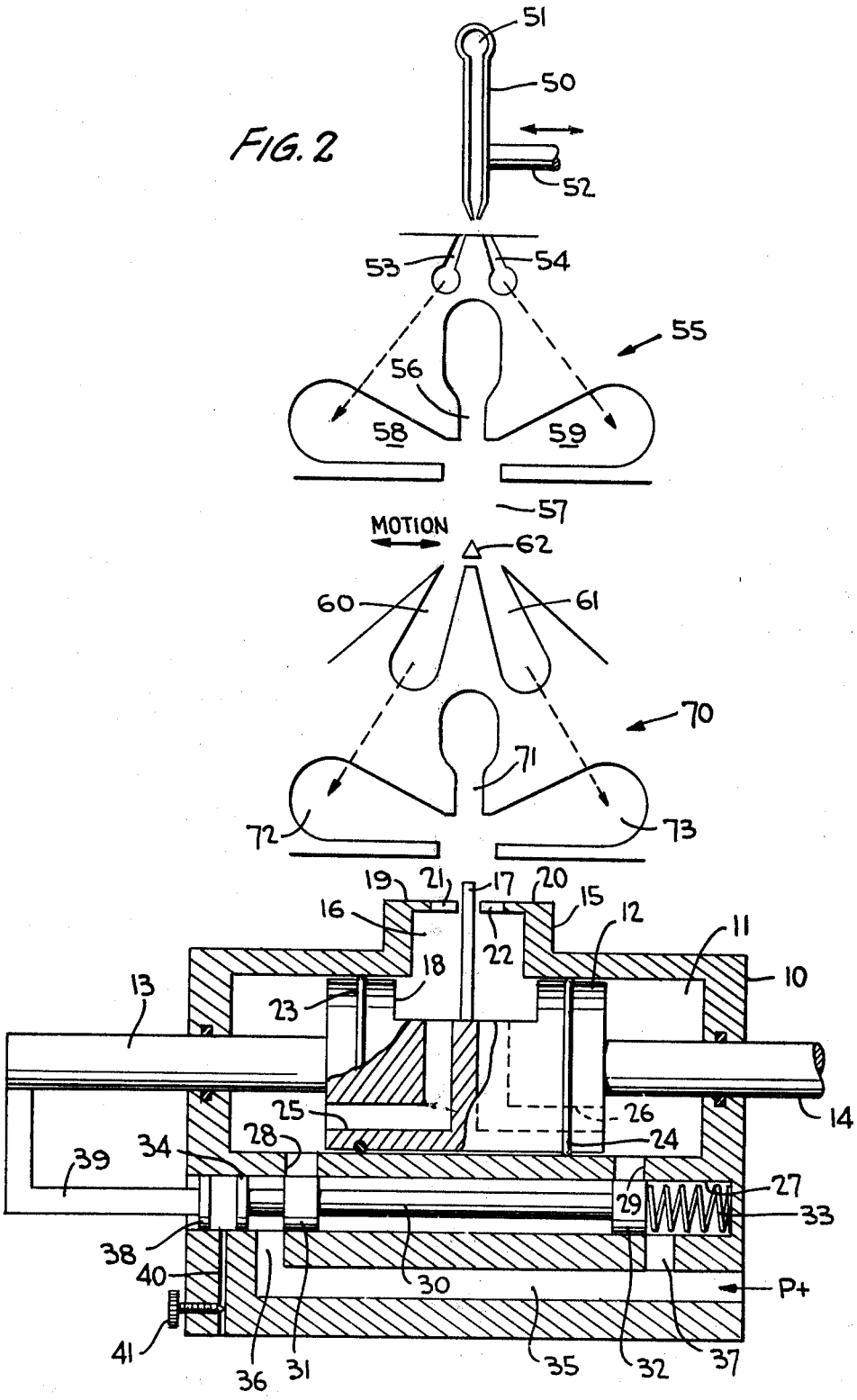
FIG. 2 is partially diagrammatic side view in section of one embodiment of the servo actuator of the present invention.

Referring specifically to FIGS. 2, 3 and 4 of the accompanying drawings, a servovalve according to the present invention includes a housing 10 having a main chamber 11 of generally cylindrical configuration. A main valve piston 12, also of generally cylindrical configuration, is movable longitudinally within chamber 11. Two rods 13, 14 extend coaxially with piston 12 from opposite ends thereof and through respective end walls of housing 10. Rod 14 is designated the output rod because it effects an output function dependent upon the position of piston 12. Rod 13 is designated as a control rod for reasons which will become clear from the following discussion.

Substantially at the longitudinal center of chamber 11 a portion 15 of the housing 10 projects radially outward to define a small subchamber 16 which communicates with chamber 11. Piston 12 has a recessed portion 18 along its periphery which, when the piston is centered in chamber 11, is aligned with projection 15. A flexible flow splitter 17, in the form of a flat rectangular member, extends radially from the base of recess 18, through subchamber 16 and out through the projecting portion 15 of housing 10. To accommodate the flow splitter 17, the outermost wall of the projection 15 is made up of two separate sections 19 and 20 which are spaced from one another by slightly more than the thickness of the flow splitter 17. In addition, wall sections 19 and 20 have respective inlet openings 21, 22 defined therein adjacent the flow splitter to permit control fluid to enter subchamber 16 on opposite sides of the splitter. Suitable O-rings 23, 24, or similar fluid sealing means are employed about piston 12 on opposite sides of subchamber 16 to preclude leakage of control fluid from the subchamber to main chamber 11 along the piston periphery.

A first control passage 25 is defined through piston 12 and extends from the base of recessed portion 18 to one end of piston 12, thereby permitting control fluid, which enters subchamber 16 via inlet 21, to flow into one end (for example, the left end, as viewed in FIG. 2) of chamber 11. A similar control passage 26 extends from the base of recess 18 to the opposite end of the piston, thereby conducting fluid received by inlet 22 to the other end (e.g the right end) of chamber 11.

A generally cylindrical bore 27 is defined in housing 10, extending generally parallel to chamber 11. Bore 27 is closed at one end, for example, the right end as viewed in FIG. 2. A pair of passages 28 and 29 communicate between bore 27 and chamber 11 and are longitudinally spaced from one another in chamber 11 by a distance greater than the length of piston 12. Further, passages 28 and 29 enter chamber 11 at locations which are on opposite sides of piston 12 when the piston is centered in that chamber. A spool valve 30 is disposed in bore 27 and has a diameter considerably smaller than the diameter of bore 27 throughout most of the spool valve length. First and second valving portions 31, 32 of the spool valve are of the same general diameter as bore 27 and are of the same general length as, or slightly longer than the longitudinal dimension of passages 28 and 29. In addition, the spacing between valving portions 31, 32 along spool valve 30 is the same as the spacing between the entrances of passages 28 and 29 into bore 27. A spring 33 is disposed between one end of bore 27 and spool valve 30 to bias the spool to a position whereby valving portions 31 and 32 of the spool valve block the entrances of passages 28 and 29, respectively, into chamber 11. An actuator portion 34 of spool valve 30 is disposed at the end of the spool valve remote from the spring 33. The diameter of actuator portion 34 is substantially the same as that of bore 27 and an O-ring 35 or the like is provided about the periphery of portion 34 to provide a pressure seal.

A supply passage 35 for pressurized fluid is also defined in housing 10 and communicates with bore 27 via two passages 36 and 37. Passages 36 and 37 are spaced by a greater distance than the spacing between valving portions 31 and 32 and are positioned such that when the spool valve 30 is in its neutral position, to which it is biased by spring 27, passage 36 is to the left of valving member 31 and passage 37 is to the right of valving member 32.

A derivative piston 38, having a diameter substantially the same as that of bore 27, is disposed in that bore proximate the open left end. Derivative piston 38 is rigidly linked to rod 13 of main piston 12 by means of a connecting rod 39 or the like. In this manner movement of piston 12 in chamber 11 is matched by movement of derivative piston 38 in bore 27. The derivative piston 38 is spaced in bore 27 from actuator member 34 or spool valve 30. A vent or bleed passage 40 communicates from ambient to the space in bore 27 between derivative piston 38 and actuator member 34. A manual adjustment member 41 is provided to selectively restrict vent passage 40.

The position command signal for positioning piston 12 in chamber 11 can be derived in any one or more of a variety of the ways illustrated. For example, a pivotable jet pipe 50 is shown pivotable about pivot point 51 in response to movement of a rod 52, or the like, secured thereto. Rod 52, in turn, may be linked to some other member having a position representing a parameter intended to control piston 12. Pipe 50 is supplied with pressurized fluid which issues from the pipe generally toward receiving passages 53 and 54. Passages 53 and 54 are positioned so that one or the other receives more fluid from pipe 50 as the pipe is pivoted. Fluid received at passages 53, 54 may be used as the input signal to a fluidic driver amplifier 70 for the servo actuator, as described below, or it may be delivered to a second input stage comprising fluidic amplifier 55. Fluidic amplifier 55 includes a power nozzle 56 which receives pressurized fluid and issues a jet thereof into an interaction region 57. Two control ports 58 and 59 are positioned on opposite sides of the issued jet and issue respective control streams which deflect the jet in proportion to the pressure of control fluid received at the control ports. In the illustrated embodiment control port 58 receives fluid from passage 53 and control port 59 receives fluid from passage 54. However, it is to be understood that control pressure signals may be used which are independent of the jet pipe 50 arrangement but which represent the command position for piston 12. A pair of output passages 60, 61 receive the power jet issued from nozzle 56 at the downstream end of interaction region, the jet being received differentially by passages 60, 61 as a function of jet deflection. Fluid received by passages 60, 61 is used as a control signal for driver amplifier 70 described below.

As described above, the command signal for positioning piston 12 may be mechanical (as by using jet pipe 50) or fluidic (as by using fluidic amplifier 55), or both. Still another form of possible input signal is electrical. To this end a small movable flow divider member 62 is positioned between outlet passages 60, 61 at the downstream end of interaction region 57. Member 62 is connected to a torque motor arm, either directly or through a linkage, and projects into the power jet across the depth (i.e. into the plane of the drawing) of interaction region 57. Member 62 is movable transversely across the interaction as a function of current applied to the torque motor and, when so moved, it distributes the jet between passages 60, 61 as a function of torque motor current. It should be understood that this electrical input may be utilized in conjunction with one or both of the mechanical and fluidic inputs or it can be used independently by simply not deflecting the power jet of fluidic amplifier 57 by means of fluid control signals at control ports 58 and 59.

The driver stage, which receives a differential pressure signal representing the position command for piston 12, is a fluidic amplifier 70. Fluidic amplifier 70 includes a power nozzle which receives fluid under pressure and issues a power jet generally toward the end of flexible flow splitter 17 which projects through projection 15 of housing 10. The jet, when undeflected, is divided equally between inlets 21 and 22 by splitter 17. Control ports 72 and 73 are disposed on opposite sides of the jet and issue control streams which deflect the jet as a function of the fluid pressure command signal applied to the control ports.

In operation, a position command signal (mechanical, electrical, fluidic or any combination thereof) for piston 12 results in a deflection of the power jet of fluidic amplifier 70 being deflected relative to flexible flow splitter 17. This results in more fluid being delivered to the space at one end of chamber 11 than to the space at the other end due to flow through passages 25 and 26. This produces a differential pressure across piston 12 which moves the piston accordingly in a longitudinal manner in chamber 11. This differential pressure can be represented as the sum of: $(\partial P/\partial x_j)\ dX_j$, which is the mechanical input; $(\partial P/\partial i)\ di$, which is the electrical input; $(\partial P/\partial P_c)\ dP_c$, which is the fluid pressure input; and $(\partial P/\partial x_s)\ dx_s$, which is the piston position feedback. In the foregoing, $x_j$ is the distance moved by jet pipe 50, $\partial P/\partial x_j$ is the pressure versus distance characteristic of the jet pipe 50 arrangement, $P_c$ is the input fluid pressure, $\partial P/\partial P_c$ is the gain of amplifier 55, i is the input electrical current, $\partial P/\partial i$ is pressure versus current characteristic of member 62 in conjunction with its driving torque motor and amplifier 55, $x_s$ is the position of piston 12 and $\partial P/\partial x_s$ is the pressure differential due to movement of the flow splitter 17.

As piston 12 moves, flexible flow splitter 17 moves therewith. However, splitter 17 is restrained from lateral movement at the point wherein it projects through members 19, 20, as best illustrated in FIG. 4. Thus, assume that the power jet is initially deflected to the left in FIG. 2 so that more fluid enters inlet 21 than inlet 22. More fluid therefore flows through passage 25 than through passage 26 and the pressure becomes greater on the left side of piston 12 than on the right. The piston moves to the right in chamber 11, causing splitter 17 to flex because it is restrained by members 19 and 20. The outer extremity of the splitter is thereby forced to flex toward inlet 21, thereby directing more of the jet into inlet 22 and less into inlet 21. This results in decreasing flow into inlet 21 and increasing flow into inlet 22, until such time as the two inlet flows are equal. The piston then is in its commanded position. In other words, the differential pressure across piston 12 is reduced to zero by the flexing of flow splitter 17 when piston 12 reaches its commanded position. The piston position is thus fed back to the driver element directly by the movement of splitter 17; no hydraulic lines or mechanical linkages are required.

Fluidic driver amplifier 70 may be a small, high impedance amplifier, thereby minimizing leakage flow, because of the use of derivative piston 38 and related components. In other words, the main disadvantage of using high impedance amplifier resides in the fact that it produces overdamping or slow response speed. Compensation for this results when the derivative piston 38 is displaced in bore 27 as piston 12 is displaced in chamber 11. When the derivative piston is moved to the right in FIG. 2, it displaces the fluid disposed between it and the actuator member 34 of spool valve 30. The displced fluid has two possible paths. One path is to ambient via bleed passage 40; the other is further into bore 27 by moving spool valve 30 in opposition to the bias force exerted by spring 33. The amount of fluid exhausted through bleed passage 40 is controlled by the setting of adjustment screw 41; the greater the exhaust flow, the less the displacement of spool valve 30, and vice versa. When spool valve 30 is displaced to the right in FIG. 2, valving member 31 unblocks passage 28 and permits pressurized fluid in passage 35 to flow through passage 28 and into chamber 11 on the left side of piston 12. Flow between passages 37 and 29 remains blocked, however, by valving member 32. The motion of member 32, as brought about from motion of spool valve 30, releases flow from the right side of chamber 11 so that the net result is an increase in pressure across the piston which re-enforces the piston movement caused by deflection of the power jet in amplifier 70. This positive feedback effect overcomes any tendency towards overdamping by quickly moving piston 12 to the commanded position in which the differential pressure across the piston is zero. The magnitude of this positive feedback is a function of how far the spool valve 30 is displaced by derivative piston 38. In this regard it is noted that spool valve 30 is displaced only when pistons 12 and 38 are moving. When the pistons are motionless, even though displaced from the centered position for piston 12, the pressure in the space between derivative piston 38 and actuator member 34 returns to ambient, permitting spring 33 to return spool valve 30 to its neutral position wherein the pressurized fluid from passages 36 and 37 acts in a balanced opposition against valving members 31 and 32. It is seen, therefore, that displacement of spool valve 30 is not proportional to displacement of piston 12; rather, it is proportional to the rate of change of that displacement. Thus, even though the motion of the piston 12 is small because of high amplifier impedance, the feedback is substantial because it is controlled by the derivative or rate of change of the driving signal. With passages 28 and 29 made relatively large, and therefore having low impedance to flow, fast response to movement of the spool valve 30 is assured.

Under conditions wherein the jet from driver amplifier 70 moves piston 12 to the left, the derivative piston 38 likewise moves to the left, thereby tending to evacuate the space between derivative piston 38 and actuator member 34. This creates a negative pressure in that space which results in ambient fluid being aspirated into the space via passage 40 (to the extent permitted by bleed adjustment 41) and also moving of the spool valve 30 to the left. This movement of the spool valve permits pressurized fluid to flow via passage 37 through unblocked passage 29 into chamber 11 where it aids in moving piston 12 to the left. Flow communication between passages 36 and 28 remain blocked so that no pressurized fluid is admitted into the left side of chamber 11, but the motion of member 31 of the spool 30 allows venting of the left side of chamber 11 to ambient.

No matter which direction the piston 12 is moved, bleed adjustment 41 provides a control over how much positive feedback is provided and therefore serves as a damping factor control.

Figure 5:
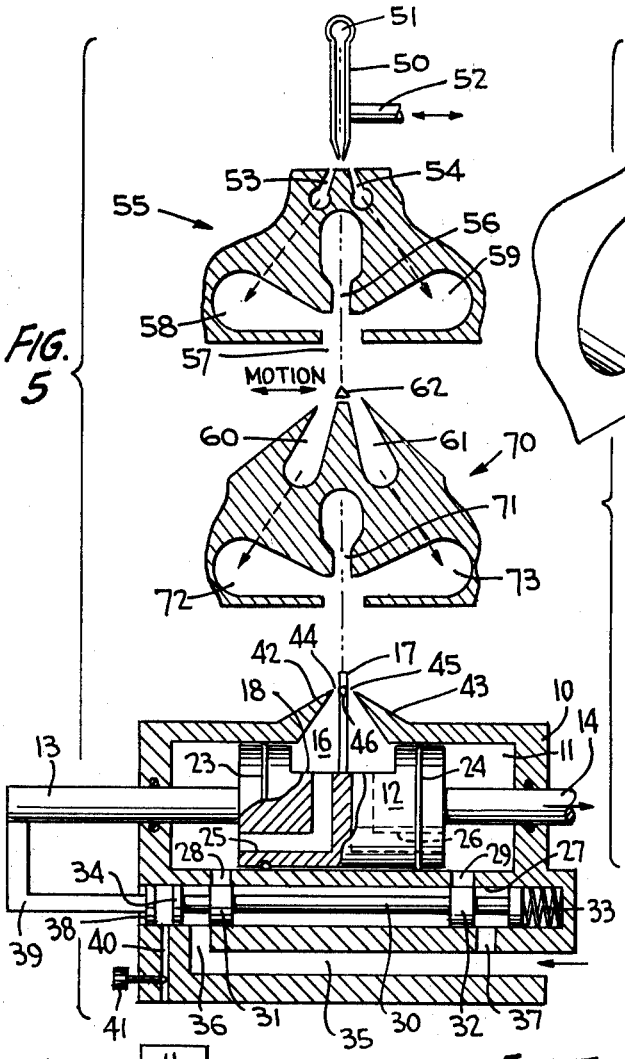
FIG. 5 is a partially diagrammatic side view in section of another embodiment of the present invention.
Figure 6:
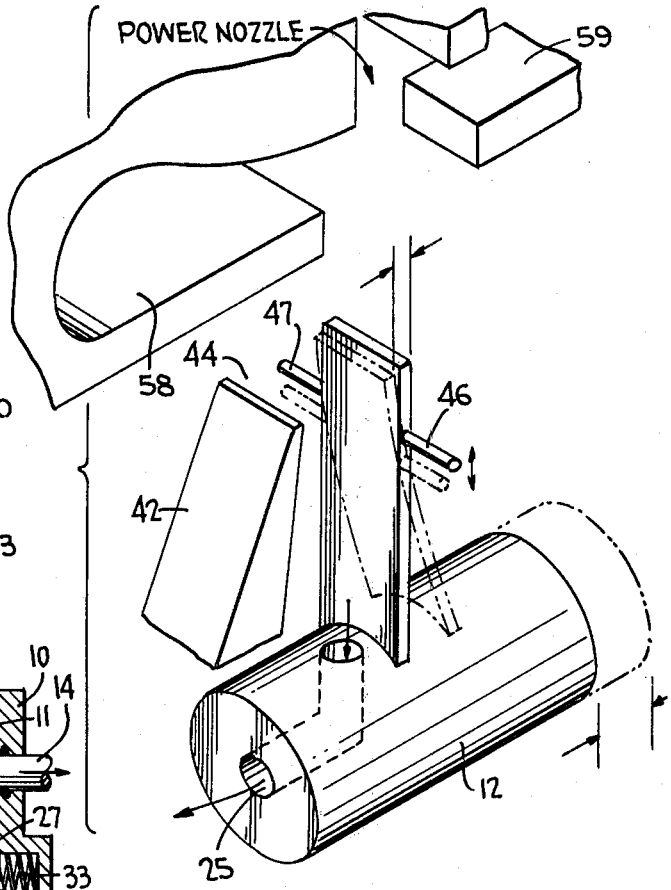
FIG. 6 is a diagrammatic view in perspective of the flow divider portion of the embodiment of FIG. 5.

A modification of the embodiment of FIG. 2 is illustrated in FIGS. 5 and 6 wherein components identical to those in FIG. 2 bear the same reference numerals. The difference in the embodiment of FIGS. 5 and 6 resides in the flexible flow splitter arrangement. Specifically, in the embodiment of FIG. 5, the housing structure itself does not restrain the lateral motion of flexible flow splitter 17. Instead, the housing 10 includes two radially-projecting members which converge toward the remote end of splitter 17 but remain separated therefrom to define inlet passages 44 and 45 on opposite sides of the splitter. The splitter is restrained by means of support pins 46 and 47 which extend from opposite edges of the splitter and are supported in vertical tracks or the like (not shown) in housing 10 which permit the pins and splitter to move vertically but not horizontally. The end result is still the same as in the previously described embodiment wherein the flexible splitter pivots about its restraint so that the end remote from piston 12 moves in an opposite direction to the piston movement. This closes off the inlet receiving the larger portion of the deflected jet from driver amplifier 70, and opens up the inlet receiving the smaller portion of that jet. The result is a direct position feedback which terminates movement of the piston when it approaches its commanded position.

It should be noted that in some cases it may be desirable to place a fluid capacitor or volume in the bleed passage 40. The purpose of such a fluid capacitance would be to provide a low impedance in the bleed passage at low frequencies and to provide damping at frequencies near resonance. The bleed passage itself constitutes a restriction-inertance combination (analogous to an electrical resistive-inductive combination). By selecting the fluid capacitance appropriately (and for this purpose an adjustable volume may be employed), the fluid circuit can be tuned to the resonant frequency of the system whereby to compensate for any underdamping that may be present at resonance.

Figure 7:
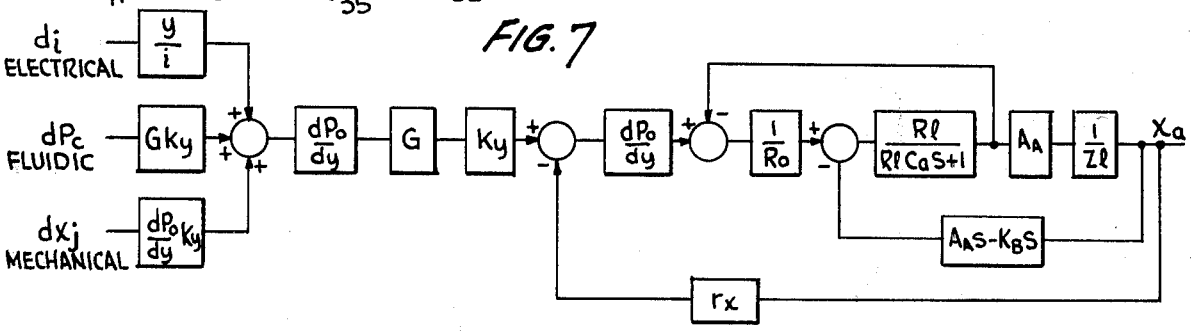
FIG. 7 is a mathematical model block diagram of the servo actuator system of the present invention.

A mathematical model of the systems of FIGS. 2 and 5 will serve to illustrate that advantageous operating characteristics of the system. Such a model is illustrated in FIG. 7. The various parameters denoted in that Figure are defined as follows:

(y/i)—torque motor displacement coefficient, in./amp.

G—pressure gain $K_y$—jet displacement at splitter for pressure input, in./psi ($dP_o/dy$)—output difference pressure (blocked output) for jet displacement at splitter, psi/in.

$R_o$—driving amplifier output resistance, lb sec/in$^5$ $R_1$—leakage resistance across actuator, lb sec/in.$^5$ $C_a$—actuator compliance, in$^3$/psi $A_A$—actuator piston area, in.$^2$ $Z_l$—load impedance, lb/in $r_x$—motion ratio, input to output $K_B$—derivative feedback, in.$^2$ The input ($dx_j$, di, $dP_c$) to the system gives rise to a jet deflection, y. Through the characteristic $dP_o/dy$ of amplifier 70, a pressure differential is created across splitter 17. This pressure across the input resistance of subchamber 16 results in flow into chamber 11. By virtue of the chamber volume, flow is integrated, thereby developing a pressure difference across chamber 11. This pressure feeds back to the input summing junction to reduce the pressure differential across the driving amplifier output resistor $R_o$. This pressure across the chamber 11 acts on the area $A_A$ of piston 12 to develop a net force differential across the piston. This force, divided by the load impedance $Z_l$, defines the actuator displacement $x_a$. The piston feeds back on the actuator flow summing junction in two ways; first the swept volume, and second, the derivative feedback. (The derivative feedback is described in detail below, and is to be taken simply as $K_B$ for present purposes.) The feedback block $A_As$–$K_Bs$ is a significant feature. The $A_As$ term is the swept volume flow and represents a system damping element common to all servovalves. For small fluidic input elements it results in severe overdamping. The $A_As$ term gives rise to a time constant which must simply be accepted as a valve response limiting factor. However, the $K_Bs$ term of the positive derivative control provides a means of offsetting this inherent servovalve limitation. It also provides the designer a means of eliminating the lag of the swept volume of actuator piston motion. Thus, not only can damping be tailored to achieve optimum system performance, but heretofore impossible system speeds-of-response can be attained, as described in examples below.

Closing the loop between actuator position $x_a$ and input jet deflection is the feedback element $r_x$. This term scales the actuator displacement to allow a larger range of gain or $x_a$ to exist. One can adjust the value of $r_x$ by adjusting the location of the pivot point to amplify or attenuate the actuator displacement.

The outer loop position feedback is the splitter 17. It is unaffected by temperature and pressure changes. Previous hydrofluidic servovalves have had feedback gain change with temperature due to viscosity since load motion was transduced into a fluid signal and this signal was processed by viscous elements before it reached the actuator. The use of a splitter coupled to the load avoids this problem.

Figure 8:
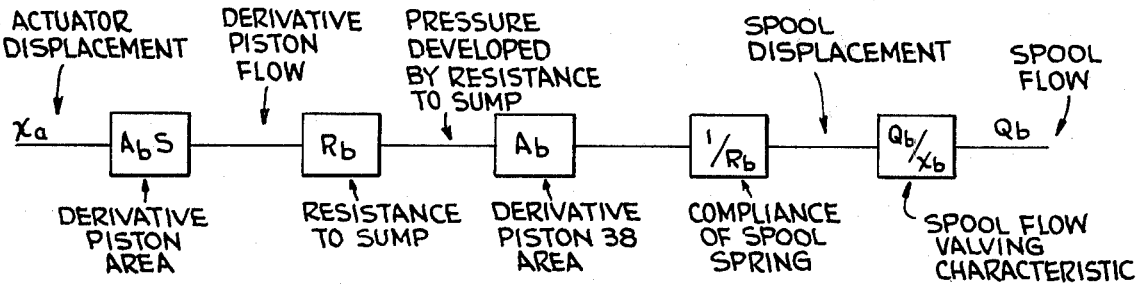
FIG. 8 is a mathematical model block diagram of a portion of the system diagrammed in FIG. 7.

The feedback element $K_B$ of FIG. 7 is derived in FIG. 8 which is a block diagram of the mathematical model for $K_B$. The block diagram reduces to:

$$\frac{Q_b}{x_a} = \left(\frac{A_b^2 R_b}{k_b} \cdot \frac{Q_b}{x_b}\right) s = K_B s \tag{4}$$

The block diagram of FIG. 7 can now be expanded by the inclusion of a general quadratic load. So doing, and reducing the inner loop, results in the mathematical model of FIG. 9, wherein Typically, $Z_l = Ms^2 + Bs + K$ M is load mass, lb sec$^2$/in.

B is viscous damping, lb sec/in.

K is load spring rate, lb/in.

Figure 9:
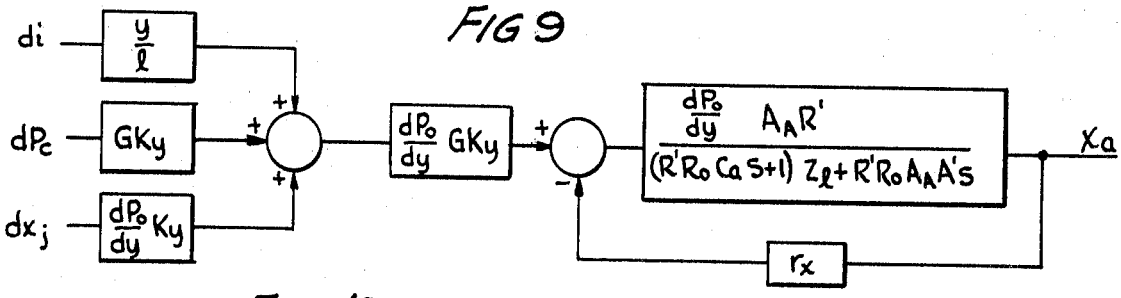
FIG. 9 is a mathematically reduced version of the mathematical model of FIG. 7.

In FIG. 9, R′ is introduced. This is defined as the actuator leakage resistance divided by the sum of the leakage resistance and the amplifier output resistance, or $R' = R_l/(R_l + R_o)$.

This is important for if $R_o$ is low, $R' \rightarrow 1$ for a pressure controlled valve, and if $R_o$ is large compared to $R_l$ as a flow controlled valve, then $R' = R_l/R_o < 1$.

In FIG. 9, there are endless variations of parameters which may be analyzed but a representative case will be evaluated first to indicate the bandwidth degradation when the driving amplifier is a low leakage, high impedance element. This will be followed by design calculations using the positive derivative feedback to provide the proper damping in the inner loop. From FIG. 9, the characteristic of the reduced inner loop is:

$$(R'R_oC_as+1)(Ms^2+Bs+K)+R'R_oA_AA's \tag{5}$$

where $(Ms^2+Bs+K)$ replaces the general mechanical impedance, $Z_l$. The term A′ is defined as $A_A - K_B$. Before examining the effect of $K_B$, first consider the two cases of a low impedance driver and a high impedance driver element alone. If a low impedance driving amplifier is used, then $R_l >> R_o$, and R′ approaches unity. In this case, if the actuator volume is small, the $R_oC_a$ time constant becomes negligible when compared to the load dynamics, and Equation (5) becomes:

$$Ms^2+(B+R_oA_A^2)s+K \tag{6}$$

The swept volume of the moving actuator load provides additional damping which is usually desirable in servo loops. This case is similar to a pressure controlled servovalve in which the valve droop essentially shunts the high resistance leakage path to provide damping. However, this is at the expense of load stiffness and flow leakage. Disturbance forces on the load can result in pressure feedback which allows flow transfer so that the load can move. In addition, a low $R_o$ implies a large driving amplifier and, thus, high flow leakage. This last characteristic is usually a reason that hydrofluidic amplifiers have difficulty competing with closed-centered valves.

In the other extreme, if a very high impedance driving amplifier were used, $R_o$ could be greater than $R_l$ and R′ approaches $(R_l/R_o)$ so that the characteristic becomes:

$$(R_lC_as+1)(Ms^2+Bs+K)+R_lA_A^2s \tag{7}$$

This solution results in stiffness in operation, but it usually has stability problems. Further, if R is too large the response is dominated by the first order lag time constant, which is $$\tau = \frac{B}{K} + R_lC_a + R_l\frac{A_A^2}{K} \tag{8}$$

Of this $(A_A^2/K)$ is usually much greater than $C_a$, so that this term becomes the limiting element in the response. If instead of $R_o >> R_l$, let $R_l$ approach $R_o$, and the term $R_l$ in the above time constant expression becomes $R_o/2$. The term constant is cut in half, but the response is still severly limited. In servo loops this has the appearance of adding excessive damping to the loop so that it is extremely sluggish.

The servovalve which is the subject of this discussion is desired to be stiff while providing a reduction of leakage flow. This implies that $R_o$ be as large as possible. However, previous hydrofluidic servovalves have resulted in $R_o$ being low in order to achieve acceptable system bandwidth. To determine the effect of the positive derivative feedback, the characteristic expression (5) is analyzed below. This feedback is through A'.

The first case to be examined is a spring load (Z=K). Without mass and damping, the system block diagram (FIG. 9) has the following forward transfer function, $$\frac{x_o}{xs_p} = \frac{\left(\frac{dP_o}{dy}\right) R' \frac{A_A}{K}}{R'R_o\left(C_a \frac{A_A A'}{K}\right) s + 1} \quad (9)$$

Assume a system having a load spring of 50 lb/in, an actuator area of 0.2 in.$^2$ and a stroke of 0.2 inches. If this system is driven by a 0.01 inch square power nozzle at 2,000 psi supply pressure (resulting in output impedance of 4000 psi/cis) the preceding transfer function gives a bandwidth of less than 0.1 Hz. If the positive feedback $K_B s$ is introduced to the extent that A'=0, (that is it exactly equals the valve damping, $A_A s$, which is the result of actuator displacement), the bandwidth exceeds 77 Hz. To have achieved this bandwidth by increasing element size without the positive feedback, a much larger element flow would be required. In fact, the flow would have to be increased by a factor of 885 and the assumed 0.01 in. square power nozzle would have to be enlarged to 0.30 in. square.

The roots of Equation (5) have been found as $A'/A_A$ is varied from 1 to 0. For $R_o$=4000 psi/cis the equation factors (with $A'/A_A=1$) into a low frequency lag and a high frequency quadratic that is considerably underdamped. As a result, a time constant equal to (77.7 Hz)$^{-1}$ coupled directly to a second order load with a natural frequency of 100 Hz and a damping ratio of 0.5 permits one to obtain an inner loop solution that is a low frequency lag at 0.089 Hz and a second order resonance at 2947 Hz with a damping ratio of 0.03. As far as the designer is concerned, this system can be characterized by the low frequency lag alone. However, in most designs this lag is unacceptable because it limits bandwidth. The designer then attempts to increase the system bandwidth by reducing the driver amplifier output resistance, $R_o$. This increase in element size, of course, increases leakage flow drain on the system. For no positive derivative feedback ($A'/A_A=1$), the effect of reducing $R_o$ can be examined. The roots for $R_o$=4000, 400 and 40 psi/cis with the 100 Hz load natural frequency are listed below to illustrate the reduction in the amplifier output impedance required to significantly increase the system bandwidth.

| Output Resistance, $R_o$ | Lag Frequency, Hz | Resonance, Hz | Damping Ratio |
|---|---|---|---|
| 4000 | 0.089 | 2947 | 0.03 |
| 400 | 0.89 | 2961 | 0.15 |
| 40 | 8.20 | 3061 | 1.28 |

The calculations show that to increase the system bandwidth about 8 Hz requires 100 times more leakage flow over the baseline example. This, in many cases, it not available to the system designer. Before examining the effect of positive feedback to achieve acceptable system bandwidth without an unacceptable flow penalty, the effect of load natural frequency on these factors has also been calculated. These results are listed for a load natural frequency of 10 Hz rather than 100 Hz of the previous example.

| $R_o$ | Lag Frequency, Hz | Resonance, Hz | Damping Ratio |
|---|---|---|---|
| 4000 | 0.00089 | 2963 | 0.014 |
| 400 | 0.0089 | 2946 | 0.13 |
| 40 | 0.088 | 2958 | 1.31 |

As can be seen, the lag break limits the bandwidth even more severely in this example of load natural frequency 10 Hz. Even accepting the high flow leakage associated with $R_o$=40, this does not provide adequate system bandwidth.

Figure 10:
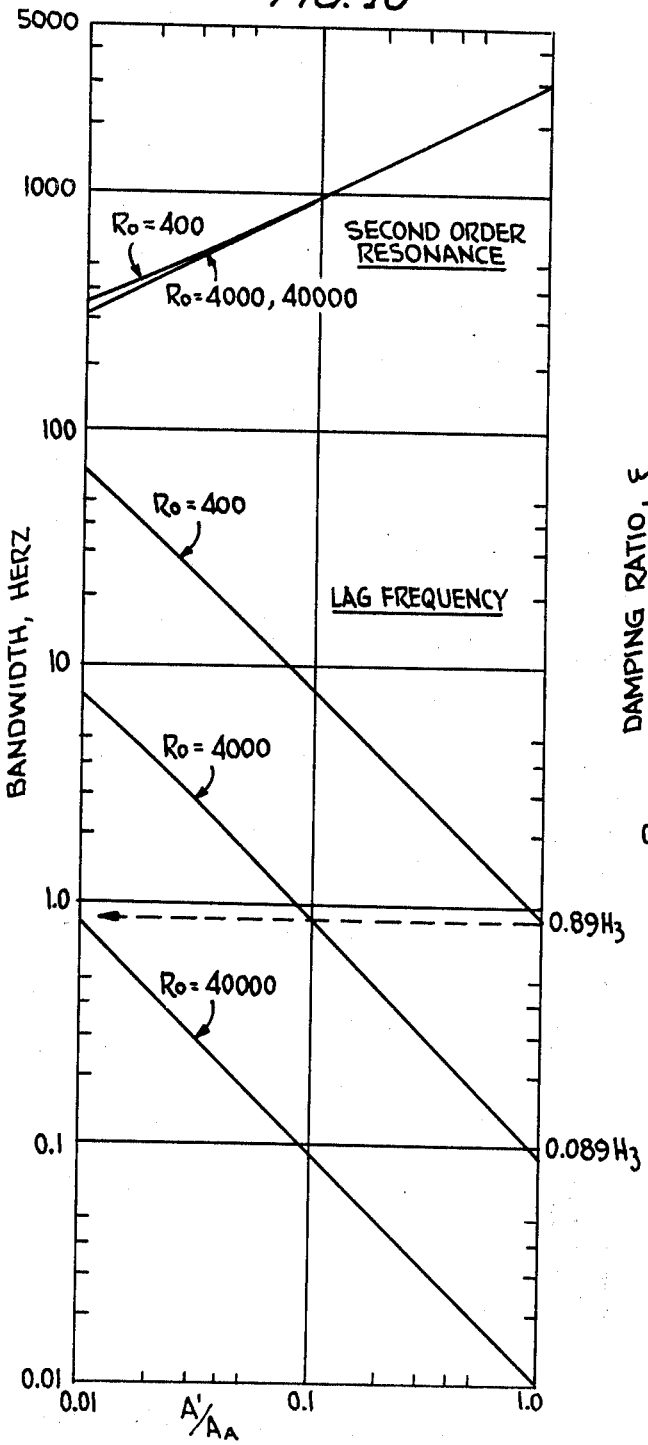
FIG. 10 is a plot of bandwidth versus the function $A'/A_A$ for the system of FIG. 9.
Figure 11:
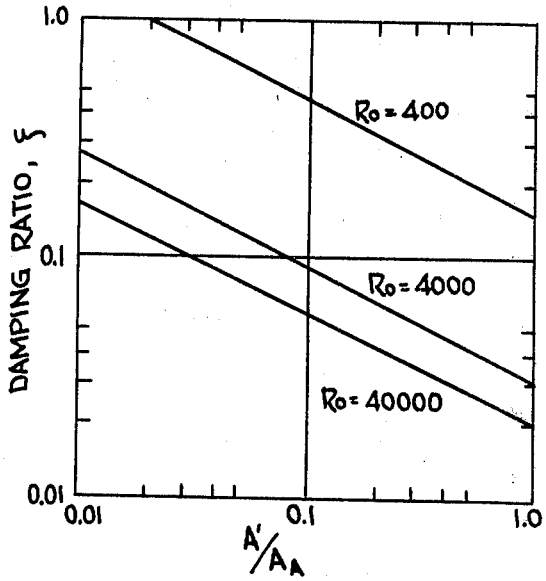
FIG. 11 is a plot of damping ratio versus the factor $A'/A_A$ for the system of FIG. 9.

The conventional solution of reducing the driver amplifier's output resistance does not offer any hope of achieving the system response within a reasonable flow budget; as a result the use of positive derivative feedback is examined. The results of solving for the roots as $A'/A_A$ is varied from 1 to 0 are shown in FIGS. 10 and 11. This figure considers the load natural frequency of 100 Hz with a damping ratio of 0.5. Three different driver amplifier output resistances are shown, the baseline case $R_o$=4000 psi/cis, $R_o$=400 psi/cis and a higher output resistance case $R_o$=40,000 psi/cis. FIG. 10 contains two parts; the lag frequency is shown on the lower part and the second order resonance on the upper part. For $A'/A_A=1$, $R_o$=4000 psi/cis (middle curve) the lag frequency of 0.089 Hz is shown as given earlier. All the way to the top of the figure at the same $A'/A_A$ value the second order resonance is given. As $A'/A_A$ is reduced, the lag frequency increases and the load resonance decreases until at $A'/A_A=0$ the lag frequency is 77.7 Hz and the load resonance is 100 Hz.

The utility of positive feedback method of extending the bandwidth without incurring a significant flow penalty can be illustrated by assuming that the bandwidth afforded by reducing $R_o$ from 4000 to 400 is adequate for this system application. If the designer achieved the necessary system bandwidth by accepting the tenfold flow leakage then the system inner loop would be characterized by a lag at 0.89 Hz and a resonance at about 2950 Hz with a damping ratio of 0.15. The system bandwidth is governed by the lag at 0.89 Hz. This same lag could be obtained with output resistance equal to 4000 psi/cis if $A'/A_A$ were reduced to about 0.1. The system would then be characterized by the lag at 0.89 Hz and a resonance at 942 Hz with a damping ratio of 0.09. However, in this case the flow leakage would be one tenth of the former. Since the load resonance appears so far out in frequency it makes little difference whether it resonances at 1000 or 3000 Hz for modeling does extend to these frequencies nor will the elements respond at these frequencies.

The system bandwidth can be extended to 77.7 Hz for the example given if $A'/A_A$ is reduced to zero. However, in the earlier example the system inner loop appeared as a simple lag, which is very easy to use with a position control loop for the load. If the bandwidth is extended to the maximum, this simple inner loop solution becomes third order and little bandwidth may be gained after the compensation is developed for the tight position control loop. The inner loop solution resulting in a sample lag is more practical.

Using FIG. 10, it is noted that the 0.89 Hz bandwidth can also be achieved with the higher output resistance $R_o$=40,000 psi/cis by reducing $A'/A_A$ to 0.01. This results in a system lag frequency of 0.89 Hz and a resonance at 300 Hz with a damping ratio of 0.18. Since there is considerable separation between the lag and the resonance, this inner loop can still be characterized by a simple lat at 0.89 Hz.

The penalty in achieving this system bandwidth without increased flow leakage is the requirement that the ratio $R'/A_A$ must be controlled with sufficient accuracy to obtain these results. This, of course, complicates the system, but advantages of achieving the bandwidth with a low cost derivative spool feedback appear to be more than worth the additional functional element.

In the design, control of the magnitude of $A'/A_A$ may be accomplished using the damping adjustment 41. This valve controls the magnitude of the pressure developed from a given load displacement rate. By adjusting this valve the system lag can be changed during operation to fine tune the control—load system performance.

Although the plots in FIGS. 10 and 11 do not extend to values of $A'/A_A$ less than 0.01, the solution of the cubic characteristic shows that the lag frequency continues to higher frequencies and the second order resonance continues to decrease until the damping becomes negative. That is, a root appears in the right half of the complex plane. This root occurs at small negative magnitudes of $A'/A_A$ for the example calculated. This result can be intuitively expected if too much positive derivative feedback is used, for an unstable system will result. It is suggested that this technique be limited to those cases where adequate system performance can be achieved with positive values of $A'/A_A$ and where the system can still be characterized by a simple lag. This of course precludes making the servovalve an integrator. From the calculations it appears as though a factor of ten in bandwidth can be achieved without any stability problems by using the positive derivative feedback.

It has been shown how the subject servovalve accepts and sums any combination of electrical, mechanical and pressure signal inputs with a resultant power jet deflection. The need for adequate flow to the actuator piston has been met through the use of positive derivative feedback with minimum amplifier element size, thereby minimizing leakage flow. In addition, load stiffness (resistance to disturbance inputs) is achieved with optimum damping by means of a controlled resistance in the derivative feedback loop. Command position accuracy has been achieved by direct feedback of actuator position to the power jet, eliminating temperature and pressure effects on output position. Examples have been presented that illustrate the extent to which performance objectives can be met without the customary leakage penalties.

It will be recognized by those familiar with the art from the foregoing description that the servo actuator described herein is capable of functioning as a position control but also as a flow control valve. In addition, it is clear that variations in configurations of the various components can be employed within the scope of the invention.

While I have described and illustrated one specific embodiment of my invention, it will be clear that variations of the details of construction which are specifically illustrated and described may be resorted to without departing from the true spirit and scope of the invention as defined in the appended claims.

I claim:

1. A servo actuator of the type wherein a first body member is moved in a chamber in response to a command signal, said servo actuator being characterized by:

first and second fluid inlets into said chamber for receiving said fluid directed thereto differentially;

a fluidic driver amplifier for providing said command signal in the form of a fluid jet which is deflected relative to said first and second inlets in proportion to the amplitude of said command signal;

means for moving said first body member in one direction in said chamber in response to the fluid flow received at said first inlet being greater than the fluid flow received at said second inlet, and for moving said first body in an opposite direction in said chamber in response to the fluid flow received at said second inlet being greater than the fluid flow received at said first inlet; and flow splitter means secured to and movable with said first body member and disposed directly in the path of said fluid jet for increasing the jet flow into said second inlet in proportion to displacement of said first body member in said one direction in said chamber, and for increasing the jet flow into said first inlet in proportion to displacement of said first body member in said opposite direction in said chamber.

2. A servo actuator of the type wherein a first body member is moved in a chamber in response to a command signal, said servo actuator being characterized by:

first and second fluid inlets into said chamber for receiving said fluid directed thereto differentially;

a fluidic driver amplifier for providing said command signal in the form of a fluid jet which is deflected relative to said first and second inlets in proportion to the amplitude of said command signal;

means for moving said first body member in one direction in said chamber in response to the fluid flow received at said first inlet being greater than the fluid flow received at said second inlet, and for moving said first body in an opposite direction in said chamber in response to the fluid flow received at said second inlet being greater than the fluid flow received at said first inlet;

flow splitter means secured to and movable with said first body member for increasing the jet flow into said second inlet in proportion to displacement of said first body member in said one direction in said chamber, and for increasing the jet flow into said first inlet in proportion to displacement of said first body member in said opposite direction in said chamber; and positive feedback means responsive to the rate of change of displacement of said first body member in said chamber for applying a positive feedback differential pressure across said first body member in a sense to aid the motion imparted to said first body member by said fluid flow received at said first and second fluid inlets, said positive feedback differential pressure being proportional to said rate of change of displacement of said first body member.

3. The servo actuator according to claim 1 or 2 wherein said first body member is a generally cylindrical piston movable longitudinally back and forth within said chamber, said piston having first and second flow passages defined therethrough for providing flow communication from said first and second inlets, respectively, to respective ends of said piston, and wherein said flow splitter means includes an elongated flexible member secured to and extending radially from said piston to a location between said first and second inlets, said flow splitter means further including means for restraining said elongated flexible member, at a point along its length displaced from said piston, from movement in the direction of piston movement in said chamber such that the end of said elongated member remote from said piston pivots about said restraint point in a direction opposite to piston movement.

4. The servo actuator according to claim 2 wherein said positive feedback means comprises:

a further chamber;

a second piston longitudinally movable in said chamber;

bias means for biasing said second piston towards a neutral position in said chamber;

a derivative piston disposed in said chamber at a location spaced from said second piston;

means linking said derivative piston and said first body member for moving said derivative piston in said chamber the same distance said first body member is moved in said chamber while displacing fluid present in the space between said derivative piston and said second piston;

means for supplying pressurized fluid to said chamber to move said first body member in said one direction in response to movement of said second piston in said one direction by said displaced fluid, and for supplying pressurized fluid to said chamber to move said first body member in said opposite direction in response to movement of said second piston in said opposite direction by said displaced fluid.

5. The servo actuator according to claim 4 further comprising bleed means for venting the space between said derivative piston and said second piston to ambient.

6. The servo actuator according to claim 5 further comprising means for adjusting said bleed means to control the amount of said venting.

7. The servo actuator according to claim 1 or 2 wherein said command signal is in the form of mechanical movement, and further comprising means for deflecting said fluid jet in proportion to said mechanical movement.

8. The servo actuator according to claim 1 or 2 wherein said command signal is in the form of an electric current and further comprising means for deflecting said fluid jet in proportion to said electric current.

9. The servo actuator according to claim 1 or 2 wherein said command signal is a differential pressure, and further comprising means for deflecting said fluid jet in proportion to said differential pressure.

10. In a servo actuator of the type wherein a first body member is moved in a first chamber in response to fluid flow which is proportioned to opposite ends of said first chamber by a command signal, an improved arrangement for increasing the speed of response of said body member to said command signal characterized by:

means responsive to the rate of change of displacement of said first body member in one direction in said first chamber for applying a differential pressure of one polarity across said first body member to aid in the displacement of said first body member in said one direction;

means responsive to the rate of change of displacement of said first body member in an opposite direction in said first chamber for applying a differential pressure of opposite polarity across said first body member to aid in the displacement of said first body member in said opposite direction;

a further chamber;

a second piston longitudinally movable in said further chamber;

bias means for biasing said second piston towards a neutral position in said further chamber;

a derivative piston disposed in said further chamber at a location spaced from said second piston;

means linking said derivative piston and said first body member for moving said derivative piston in said further chamber the same distance said first body member is moved in said further chamber while displacing fluid present in the space between said derivative piston and said second piston; and means for supplying pressurized fluid to said first chamber to move said first body member in said one direction in response to movement of said second piston in said one direction by said displaced fluid, and for supplying pressurized fluid to said first chamber to move said first body member in said opposite direction in response to movement of said second piston in said opposite direction by said displaced fluid.

11. The servo actuator according to claim 10 wherein said fluid flow is a fluid jet and said command signal is in the form of mechanical movement, and further comprising means for deflecting said fluid jet in proportion to said mechanical movement.

12. The servo actuator according to claim 10 wherein said fluid flow is a fluid jet and said command signal is in the form of an electric current and further comprising means for deflecting said fluid jet in proportion to said electric current.

13. The servo actuator according to claim 10 wherein said fluid flow is a fluid jet and said command signal is a differential pressure, and further comprising means for deflecting said fluid jet in proportion to said differential pressure.

* * * * *